US006047701A

United States Patent [19]

Feldman

[11] Patent Number: 6,047,701

[45] Date of Patent: Apr. 11, 2000

[54] TRAY WITH GROOVES AND SLOTS FOR RECIRCULATION OF MOIST AIR FOR A HUMIDOR IN OPERATION

[76] Inventor: Marvin Karpa Feldman, Sócrates No. 385-ler.. Piso, Colonia Polanco, C.P. 11560, México, D.F., Mexico

[21] Appl. No.: 08/957,879

[22] Filed: Oct. 15, 1997

Related U.S. Application Data

[63] Continuation-in-part of application No. PCT/MX96/00022, Dec. 16, 1996, abandoned.

[51] Int. Cl.[7] ..... A24B 1/02; A24F 13/00; A24F 25/00; B65D 1/34

[52] U.S. Cl. ..... 131/303; 131/302; 131/329; 312/31; 206/562; 206/564; 206/231.1

[58] Field of Search ..... 131/302, 303, 131/329; D27/186, 187, 189; 62/176.4, 176.6; 312/31, 31.1, 31.2, 31.3, 31.03; 206/564, 562, 213.1

[56] References Cited

U.S. PATENT DOCUMENTS

| | | | |
|---|---|---|---|
| D. 140,447 | 2/1945 | Pritzker . | |
| 163,313 | 5/1875 | Heyl . | |
| 273,205 | 2/1883 | Wentzell et al. . | |
| D. 372,138 | 7/1996 | Pasquale et al. . | |
| 441,557 | 11/1890 | Heydt . | |
| 510,928 | 12/1893 | Parish . | |
| 693,469 | 2/1902 | Wagner et al. . | |
| 720,111 | 2/1903 | Castillo . | |
| 1,054,159 | 2/1913 | Wilson . | |
| 1,268,163 | 6/1918 | Schneider | 312/31 |
| 1,474,264 | 11/1923 | Karp . | |
| 1,668,892 | 5/1928 | Durham . | |
| 1,676,118 | 7/1928 | Sukert . | |
| 1,712,024 | 5/1929 | Brogden . | |
| 1,954,577 | 4/1934 | Reddin . | |
| 2,219,959 | 10/1940 | Laidley . | |
| 2,281,617 | 5/1942 | Ramsdell . | |
| 2,323,820 | 7/1943 | Lilienfield . | |
| 2,474,173 | 6/1949 | Trinko . | |

(List continued on next page.)

FOREIGN PATENT DOCUMENTS

| | | |
|---|---|---|
| 0 086 117 | 1/1983 | France . |
| 0 103 857 | 9/1983 | Germany . |
| 0 220 357 | 1/1986 | Germany . |
| 0 348 840 | 6/1989 | Germany . |
| 0 363 194 | 10/1989 | United Kingdom . |
| 0 560 578 | 3/1993 | United Kingdom . |

*Primary Examiner*—Stanley S. Silverman
*Assistant Examiner*—Dionne A. Walls
*Attorney, Agent, or Firm*—Porter, Wright, Morris & Arthur LLP

[57] ABSTRACT

The present invention comprises a tray with grooves and slots for recirculation of moist air for a humidor in operation, intended to conserve products, typically cigars, fresh and in their natural state. These grooves or channels are substantially parallel to each other, and each rounded groove preferably contains a lengthwise slot through the tray from the top to the bottom surface and located substantially in the bottom center of the rounded groove. These slots provide for the recirculation of moist air around and through each individual product. The humidor of the present invention consists of a plurality of such product-containing trays stacked and spaced vertically in a suitable case, including means for removal of the trays for insertion or removal of product. Space for moist air circulation is also provided around each sliding tray. The humidor of the present invention also contains a source of moisture and humidity sensing means. When low humidity is detected, a fan is activated to humidify the interior of the case until the measured humidity reaches the pre-set level. In the present invention, the water reservoir source of moisture for humidification and the means for circulating humidified air are sufficient so as to avoid the requirement of a hermetically sealed case, and sufficient to avoid serious disruptions in humidification when the case is briefly opened for the insertion or removal of product.

13 Claims, 7 Drawing Sheets

U.S. PATENT DOCUMENTS

| | | |
|---|---|---|
| 2,506,191 | 5/1950 | Bayuk . |
| 2,680,046 | 6/1954 | McDonald . |
| 2,860,023 | 11/1958 | Herdlitchka . |
| 2,977,171 | 3/1961 | Gleason . |
| 3,307,902 | 3/1967 | Nardi . |
| 3,336,093 | 8/1967 | Phelps . |
| 4,008,930 | 2/1977 | Swainson . |
| 4,064,203 | 12/1977 | Cox . |
| 4,135,311 | 1/1979 | Imbert . |
| 4,534,369 | 8/1985 | Jenkins . |
| 4,962,850 | 10/1990 | Monto . |
| 4,997,082 | 3/1991 | Durocher . |
| 5,011,009 | 4/1991 | Scheurer . |
| 5,277,315 | 1/1994 | Pleia . |
| 5,556,579 | 9/1996 | Newman . |
| 5,607,051 | 3/1997 | Espinosa . |
| 5,651,262 | 7/1997 | Pendergast . |

TRAY WITH GROOVES AND SLOTS FOR RECIRCULATION OF MOIST AIR FOR A HUMIDOR IN OPERATION

RELATED APPLICATIONS

This application is a continuation-in-part of International Application Serial Number PCT/MX96/00022, with international filing date of Dec. 16, 1996, now abandoned as to the US. This application claims priority from Mexican Application Serial Number 965035 filed Oct. 23, 1996.

FIELD OF THE INVENTION

The present invention relates to humidors for storage of humidity-sensitive products, and more particularly to sliding and slotted trays, having grooves with slots therein, for storage of individual humidity-sensitive materials, typically cigars, in conjunction with a humidification system maintaining substantially constant humidity in a non-hermetically sealed case and reducing rapid humidification changes caused by inserting or removing cigars from the case.

BACKGROUND OF THE INVENTION

It is well known that there are numerous products in the stream of commerce which, if not immediately consumed but stored for some period of time prior to consumption, lose their freshness and their natural state is altered due to climatological conditions, typically humidity. This is the case for cigars and other tobacco products although the deterioration of cigars due to improper humidification seems to be more objectionable to the discerning user than is true for other tobacco products. Due to this deterioration, many people have chosen to conserve such humidity-sensitive products by means of storage under refrigeration where conditions of low temperature retard the process of drying. However, prolonged storage under refrigeration (especially frost-free refrigeration) will also lead to drying of the product. In addition, refrigerator storage incurs the risk that the cigars or other tobacco products so stored will absorb the characteristic aromas of other foods, or vice versa. Thus, the cigars' flavor and natural characteristics show a slight or complete variation, perhaps taking on some of the flavor or aroma characteristics of commonly refrigerated food products, which is extremely disagreeable for consumers. Food products taking on characteristic aroma and/or flavor of tobacco will likely be equally disagreeable to the consumers of such food products. Thus, refrigerated storage as typically done in a residence has serious drawbacks.

Existing boxes or cases for storing cigars typically do not provide the proper humidity control to avoid the cigars' drying up as time goes by. This typically results in consumer dissatisfaction that said cigars are partially or totally dried out and are inconsumable and, therefore, must be discarded.

The preceding problems related to storage at improper temperature and/or humidity do not arise solely with cigars but also in a variety of products such as medicines, foods, etc., so that it has become necessary to provide temperature and humidity controlled equipment other than refrigerators. Such boxes and cases are typically known as humidors and can be of different sizes and applications. These generally do not completely solve the aforementioned problems, since they contain trays, platters or dividing sections that lack channels or grooves and means for recirculation of air, so that the products stored therein often have their taste, aroma or other characteristics altered. Often these products are inconsumable following such improper storage and must be discarded.

The present invention comprises a combination of several features designed to solve the above problems. The present invention comprises a tray for holding individual products, typically cigars individually in separate depressions for stable storage. For economy of language, we will refer to "cigars" as the contents of the humidor as this is expected to be the primary utility of the present invention. However, we do not intend to exclude thereby similar or related products requiring humidity and/or environmental control offered by the present invention, as will be obvious to those having ordinary skill in the art.

The trays of the present invention have slots therein allowing prompt and effective circulation of moisture throughout and around each individual cigar. In addition, the present invention also contains a water reservoir and a humidification means, typically driven by means of an electric fan, for maintaining the humidity at the correct level. This combination of features of the present invention offers several advantages over separate usage of individual elements as commonly done in the prior art.

The humidification means of the present invention is sufficiently robust that a sealed case is not required. Modest exchange of interior (properly humidified) air with the ambient air, typically having improper humidification for correct storage of the cigars (or other material) does not result in substantial loss of appropriate humidification in the region surrounding the cigars. In contrast to the prior art, the present humidification device and case have a configuration and performance characteristics such that cigars can be inserted and removed from the humidification zone with only modest and temporary disruption of the humidification levels without serious or permanent disruption of the cigar's characteristics.

SUMMARY OF THE INVENTION

The present invention comprises, in part, a tray with grooves and slots for recirculation of moist air for a humidor in operation, intended to conserve products fresh and in their natural state, typically cigars. This tray is made of a durable and moisture and temperature resistant material such as certain woods, typically cedar, and consists of a board having in its upper surface a plurality of product-receiving rounded and elongated grooves. These grooves or channels are substantially parallel to each other. Each rounded groove preferably contains a lengthwise slot through the tray from the top to the bottom surface and located substantially in the bottom center of the rounded groove. These slots provide for the recirculation of moist air around and through each individual product. The humidor of the present invention consists of a plurality of such product-containing trays stacked and spaced vertically in a suitable case, including means for removal of the trays for insertion or removal of product. Sliding trays in channels located in the interior walls of the case is the preferred mode for maintaining vertical separation and spacing while allowing ready access for product insertion or removal. Space for moist air circulation is also provided around edges of each sliding tray when the tray contains products and is placed in a humidor in operation with the access doors in their closed position. Likewise, said sliding trays preferably include in the center of their front edge, a handle. When previously filled with cigars, the tray is placed into a humidor provided with means for control of the humidity, preferably a motor, a fan and a source of moisture. The humidor of the present invention also contains a water reservoir, a source of moisture and humidity sensing means. When low humidity is detected, the fan is activated to humidify the interior of the case until the measured humidity reaches the pre-set level, typically pre-set by the user upon installation. In the present invention, the source of moisture for humidification and the means for circulating humidified air are sufficient so as to avoid the requirement of a hermetically sealed case, and sufficient to avoid serious disruptions in humidification when the case is briefly opened for the insertion or removal of product.

One objective of the present invention is to provide a humidor tray on which cigars may be placed individually and separately which must conserve their freshness and natural state for short or long periods of time in a humidor in operation.

Another objective of this invention is to provide a humidor tray made of a material with intrinsic qualities such as being durable, moisture resistant, easy to polish, cut and work.

Yet another objective of this invention is to provide a humidor tray which is easy to charge with products and to discharge the same in order to clean, transport, insert it into a humidor and remove from the same, with reduced risk of damage to the humidor, the tray and the products contained in the same.

Still another objective of this invention is to provide an attractive and lightweight tray.

Yet another objective of the present invention is to provide for effective circulation of humidified air to each individual product.

Another objective of the present invention is to provide sufficiently rapid humidification so as to avoid the necessity of a hermetically sealed case.

Another objective of the present invention is to provide sufficiently rapid humidification so as to avoid serious humidity disruptions when the humidor of the present invention is briefly opened for the insertion or removal of product.

Yet another objective of the present invention is to provide a humidor equipped with humidity sensing means connected to the humidification means so as to activate the humidification means when low humidity is detected and to deactivate the humidification means when adequate humidity is present.

PREFERRED EMBODIMENTS OF THE INVENTION

Considering each and every of the disadvantages of the earlier technique and the objectives indicated above, in addition to many others not mentioned, the inventor of the present application developed a humidor tray which contains grooves with slots for recirculation of fresh air in different directions when it contains products co-located in its grooves that must conserve their freshness and natural state, and it is placed into a humidor in operation. These trays apparently overcome the disadvantages of the prior technique and provides many advantages in the art.

The tray of this application is manufactured of a durable material that is resistant to moisture and temperature such as certain woods, typically cedar, which makes this tray aesthetically pleasing and agreeable to the eye. Therefore, for best results, said tray is preferably placed in a humidor in operation which is also made of wood, typically cedar, mahogany or walnut.

The tray in question is typically comprised of a sliding section with many elongated round grooves which receive products, which are parallel to each other on its upper surface. Each groove has preferably a longitudinal slot therein for recirculation of moist air in different directions for use in a humidor in operation, so that every and each of the products contained in said grooves maintain a constant and proper moisture and temperature so that their initial properties and characteristics are not altered. When these products are cigars, they conserve their freshness and natural state. That is, said humidified cigars for a short or long period of time have qualities practically the same as those of recently produced cigars, which provides a very pleasant sensation to the most demanding smokers.

The tray of the present invention may be rectangular, square, large, medium or small and configured to be placed in a humidor with the corresponding dimensions and form. The grooves of said tray may be wide or narrow and have one or both rounded ends. This tray may contain on its front edge one or several indentations and one or more attachment devices, said attachment devices may be projections, circumferential sections, handles with different configurations, etc.

Figure 1:
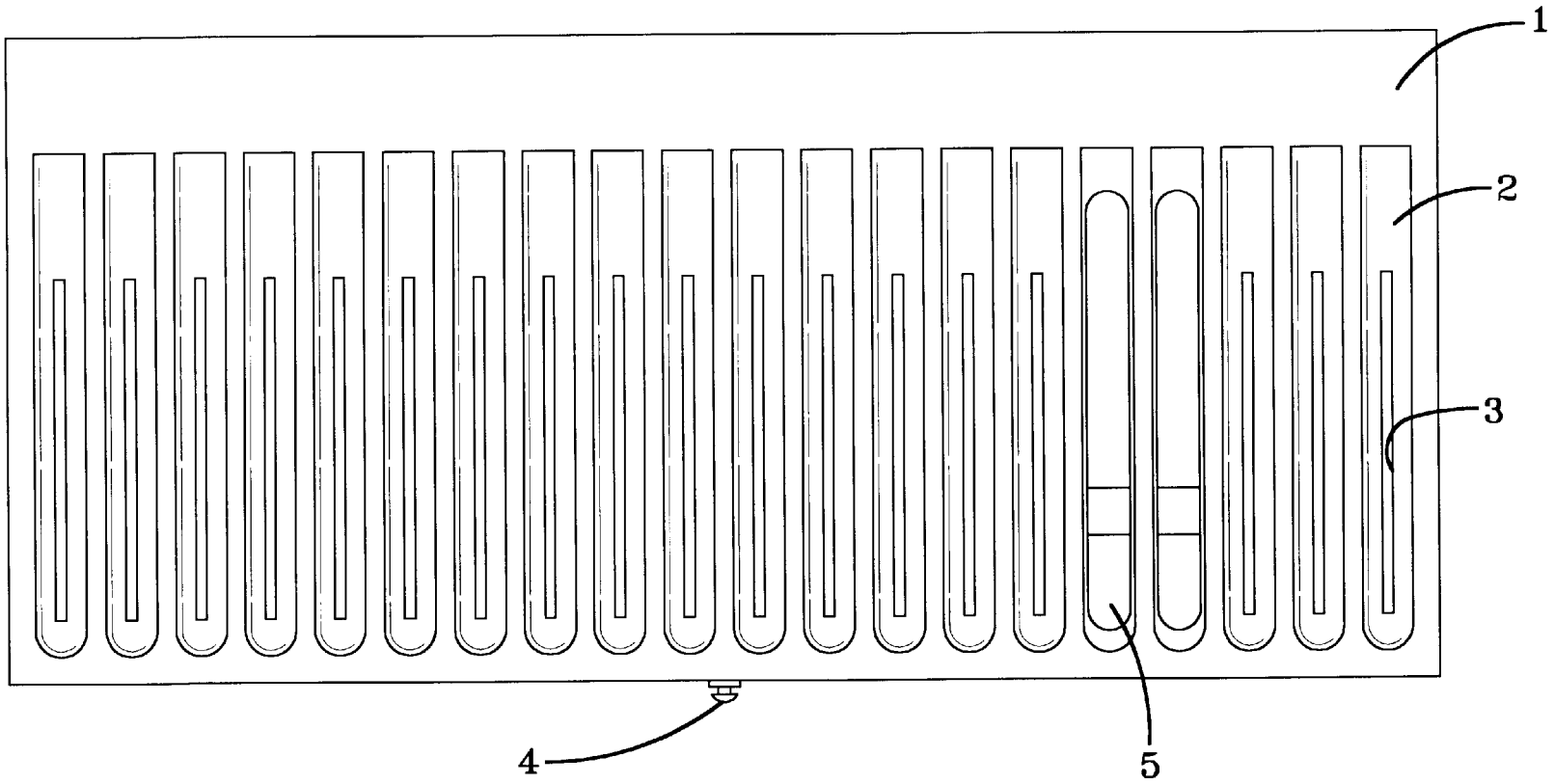
FIG. 1 is a top plan view of the humidor tray with grooves and slots for circulating the air of the present invention, containing some cigars indicated by dotted lines.
Figure 2:
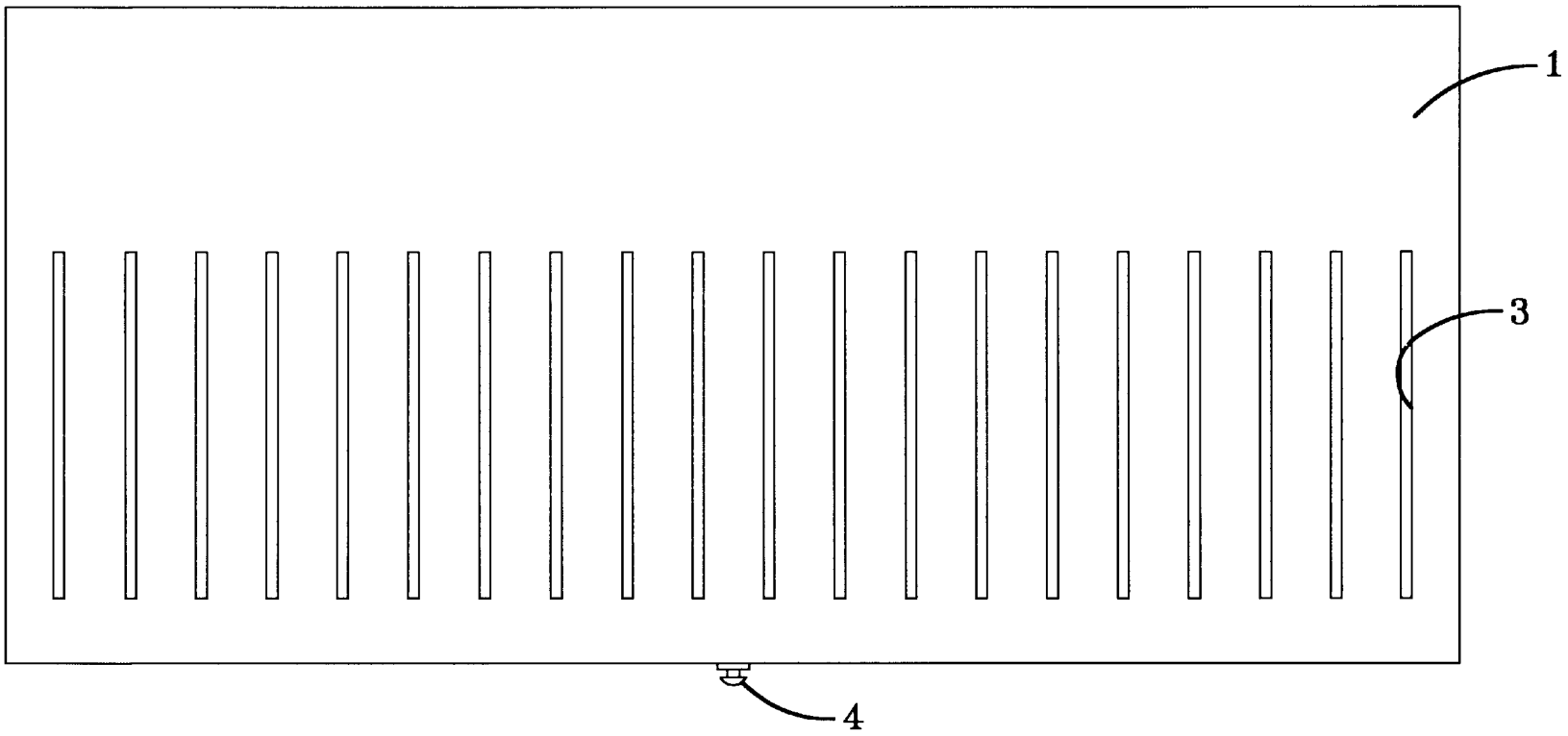
FIG. 2 is a lower plan view of the same as in FIG. 1

The tray with grooves and slots for recirculation of air for a humidor in operation, of the present invention, in the preferred embodiment is of a practically rectangular configuration and is intended to conserve fresh cigars and in their nature state. Said tray is typically made of cedar and consists, as shown in FIGS. 1 and 2, of: one rectangular sliding board 1, the upper surface of which contains a number of cigar-receiving, rounded and elongated grooves 2, said grooves 2 being arranged parallel to each other and also parallel to the shorter sides of the sliding board 1. Each rounded groove 2 also typically contains in its lowest portion a longitudinal slot 3 for recirculation of moist air when said tray contains products and is into a humidor in operation. In addition said sliding board 1 typically includes in the center of its front edge a handle 4.

Figure 3:
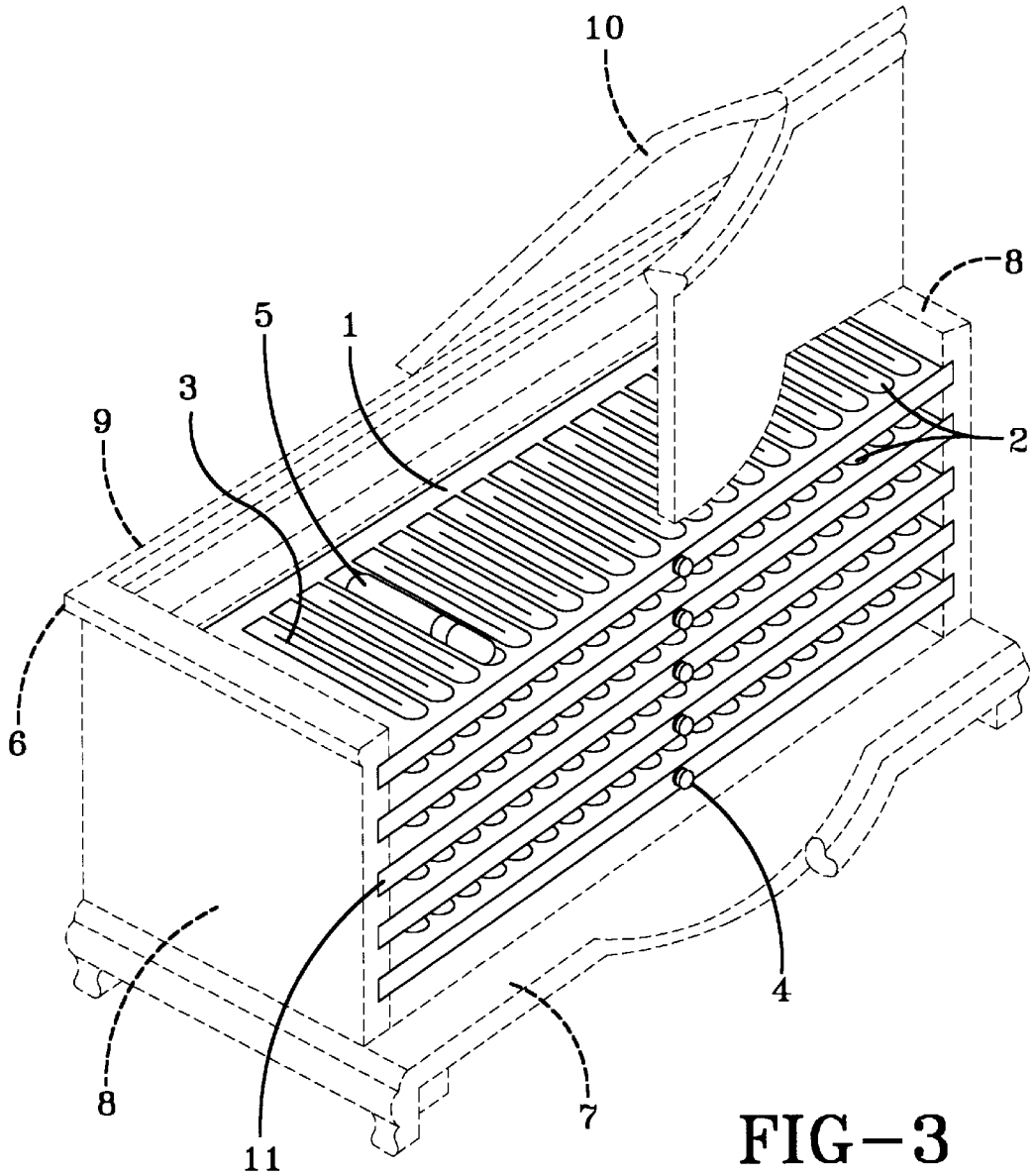
FIG. 3 is a front conventional perspective view of a plurality of trays with grooves and slots for recirculation of air, of the present invention, placed in an open humidor represented by dotted lines and said trays containing cigars also represented by dotted lines.

In this embodiment, one or more cigars denoted collectively by 5 which are desired to conserve fresh and in their natural state, are typically placed in the cigar receiving rounded grooves 2. Said tray, 1, as filled in whole or in part with the cigars 5, is placed into furniture or humidor 6, which also is rectangular in form and is made of wood, typically cedar-in a preferred embodiment, indicated by dotted lines in FIG. 3.

Said humidor 6 is comprised of a lower section 7, two side walls 8, one back wall 9 and a foldable top 10 that covers both the top and front portions of said humidor 6. In the inside of both side walls 8 are a plurality of long and narrow, recessed stylized rectangular projections 11, transversely directed and equidistantly located and separated, into which the trays slide completely or partially filled with cigars or else empty, for placement in said humidor 6 or for removal from the same.

In the lower section 7 of the humidor 6, is amotor 12, a fan 13 and a humidistat 14 (including a water reservoir) with a humidity control. When said humidor 6 is in operation, the motor 12 causes fan 13 to move, which produces movement of the surrounding dry air. This dry air is charged with moisture from the water contained in the humidistat 14. Said moist air is transferred into the interior atmosphere of said humidor 6. That is, the moist air is recirculated through the slots 3 in different directions, as indicated by the arrows F in FIG. 4. This circulation pattern, making use of slots 3 to maintain contact with each individual cigar, causes each individual cigar to remain fresh and in its preferred state for short or long periods of time. In other words, the maintenance of freshness in this invention is due to the environment of controlled humidity produced by the constant and controlled recirculation of moist air around the periphery of every and each of the cigars.

The present invention uses humidistat 14 to measure and activate the fan, 13 whenever a condition of low humidity is detected. The proper level of humidity can be adjusted by the user of the humidor or factory pre-set. In any case, the feed-back mechanism for maintaining proper humidity levels is an important feature of the present invention.

The fan, 13, and moisture supply contained in humidistat, 14, is selected in the practice of the present invention to be sufficiently large that tight sealing of the humidor case, 6, is not necessary. That is, the humidification system of the present invention has sufficient humidification capacity to compensate for leakage out of case 6. In addition, the humidification system of the present invention typically has sufficient capacity such that modest openings of the case for reasonably brief periods of time, such as for insertion or removal of cigars, will only temporarily and insignificantly disrupt the humidification of the overall humidor.

Figure 4:
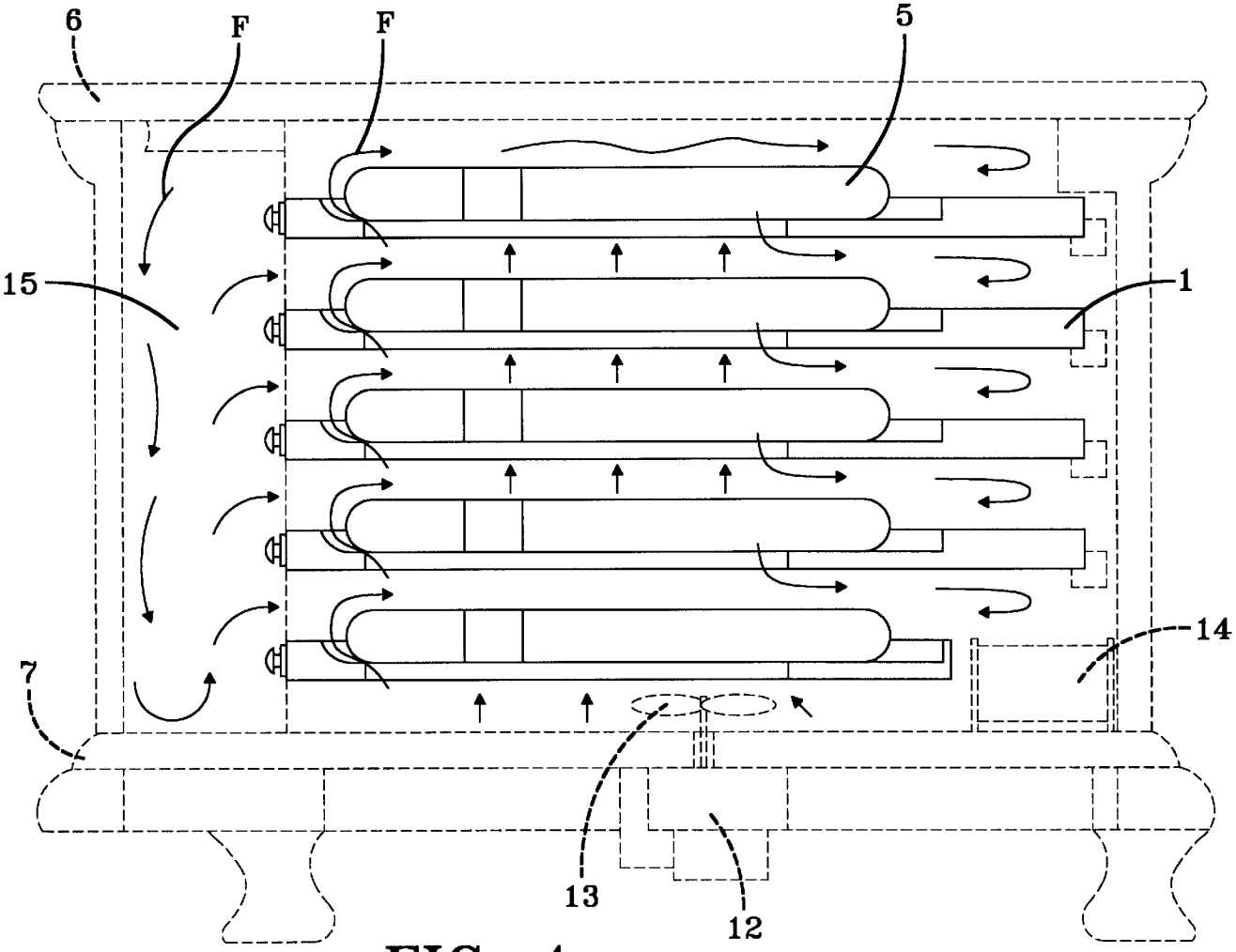
FIG. 4 is a longitudinal cross section view of the FIG. 3, with both the tray and the humidor in operation.
Figure 5:
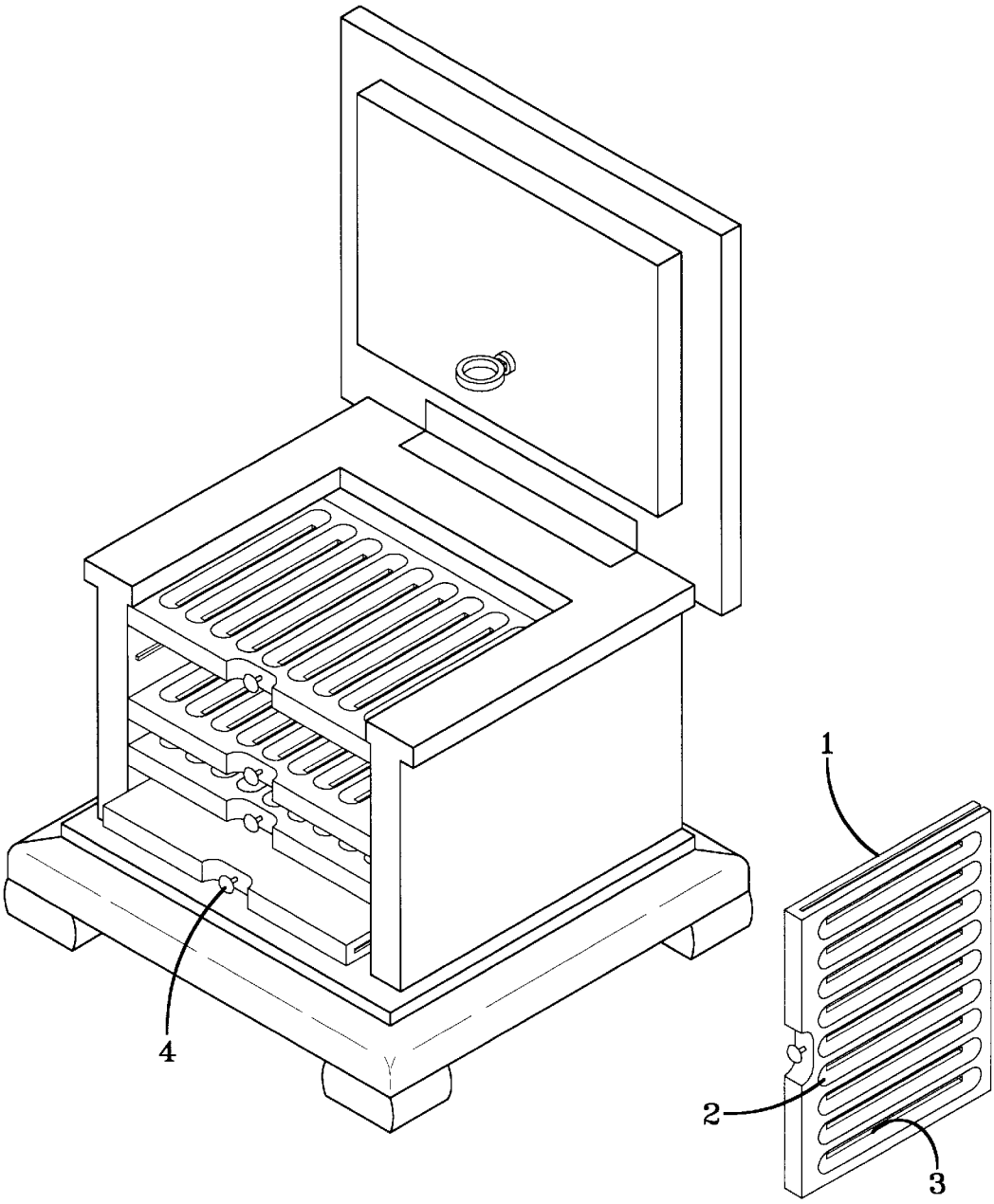
FIG. 5 is a perspective view of the humidor of the present invention in its open condition showing one tray removed.
Figure 6:
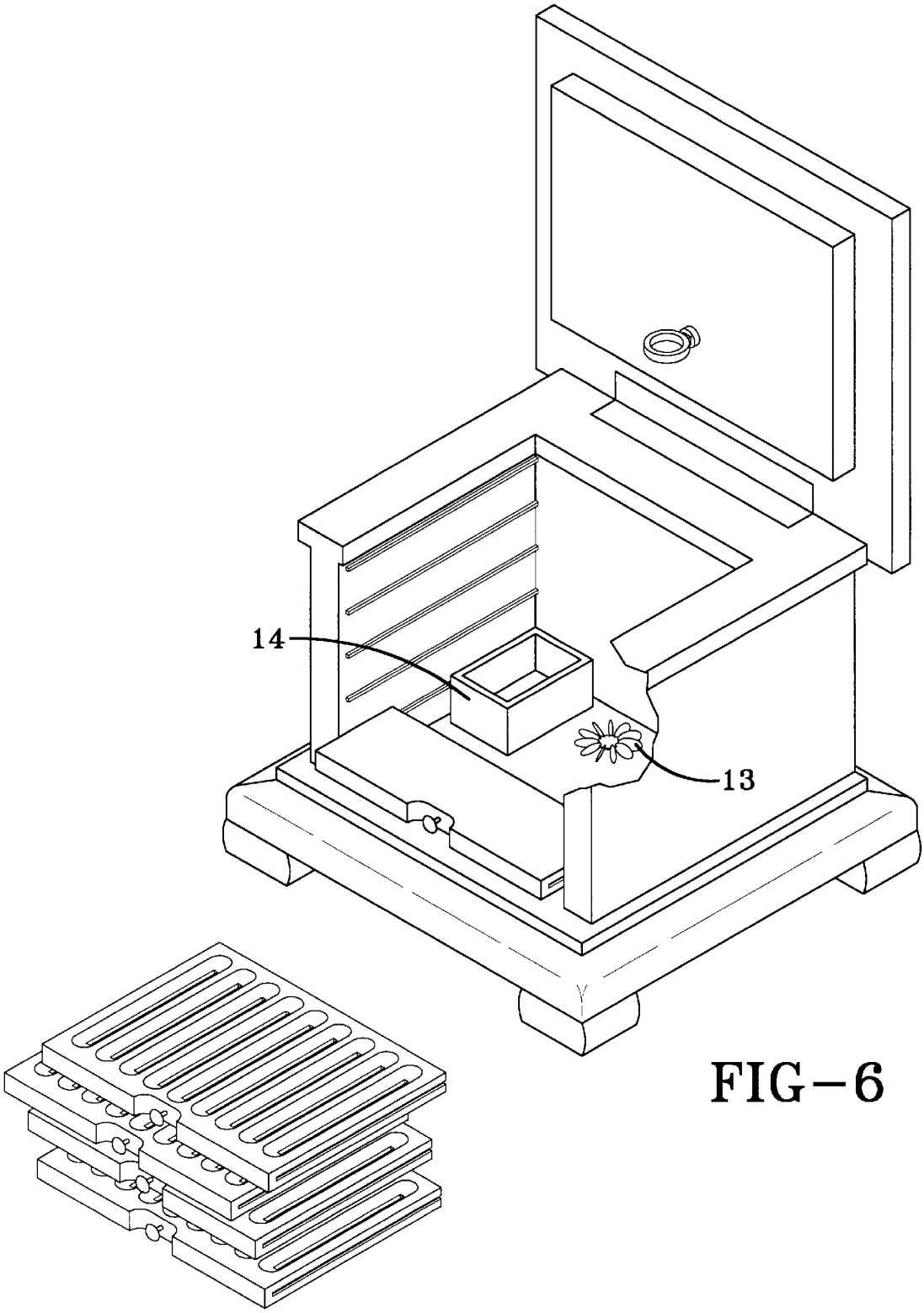
FIG. 6 is a perspective view of the humidor of the present invention in its open condition showing all trays removed and the humidification means and fan assembly.
Figure 7:
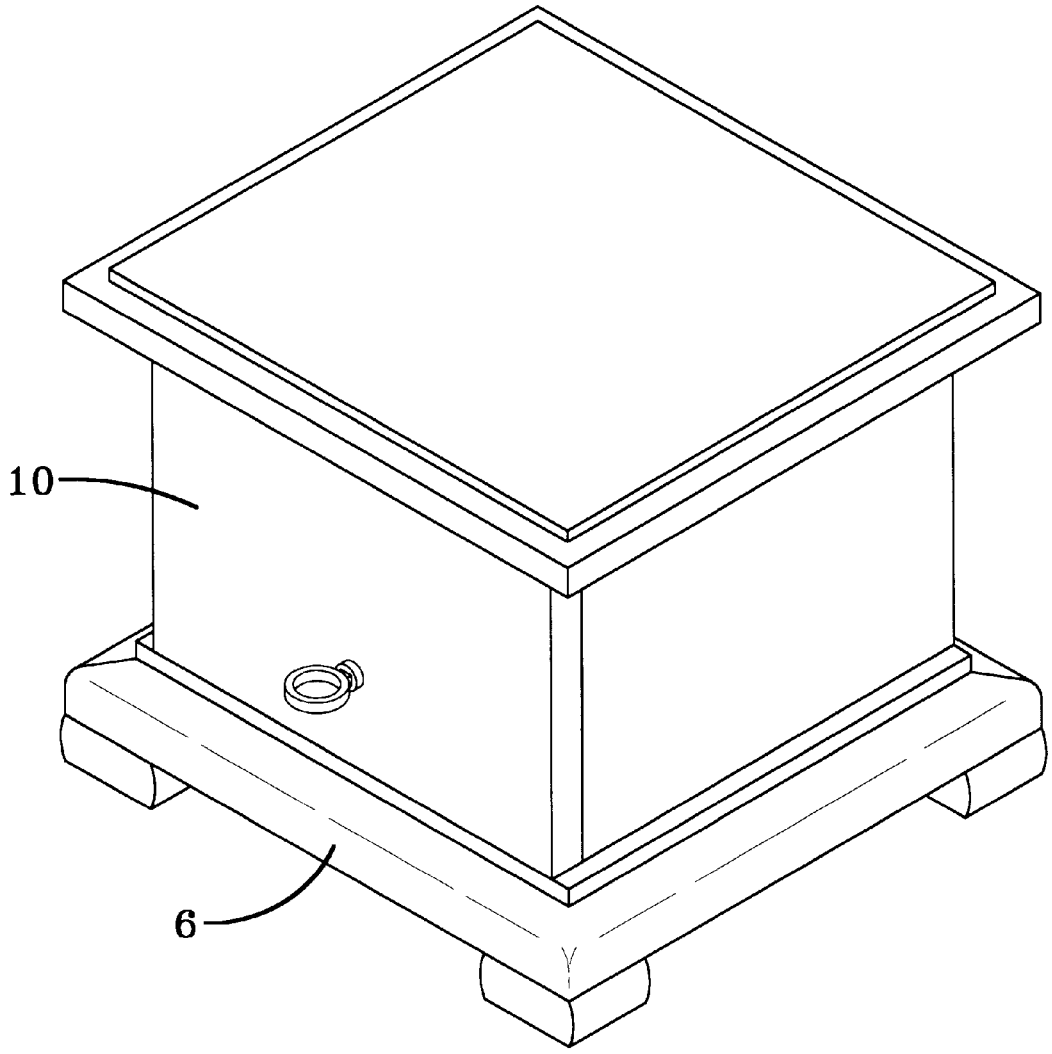
FIG. 7 is a perspective view of the humidor of the present invention in its closed condition.

In addition to providing slots, 3, for the circulation of moist air in the region of the cigars, the humidor of the present invention also provides for circulation of moist air around all trays, denoted by space 15 on FIG. 4. Another path for moist air comprises the regions surrounding grip, 4, vertically aligned on all trays. Thus, the combination of slots in the cigar-containing grooves and the paths around the stack of trays provides in the present invention an effective and efficient moisture carrying system for maintaining cigars in their proper moist condition.

Having described the invention in detail, those skilled in the art will appreciate that, given the present disclosure, modifications may be made to the invention without departing from the spirit of the inventive concept herein described. Therefore, it is not intended that the scope of the invention be limited to the specific and preferred embodiments illustrated and described. Rather, it is intended that the scope of the invention be determined by the appended claims.

I claim:

1. A tray for supporting material in a humidor comprising:

a sliding board having in its upper surface a plurality of grooves adapted for receiving said material, said grooves arranged parallel to each other and each of the grooves having in its lowest part a lengthwise slot completely through said tray, said slot adapted to permit circulation of moist air therethrough in contact with said material while supporting said materials therein, said tray, grooves and slots having a configuration such as to direct moist air in a humidor to pass through the slots and recirculate in different directions, providing continuously proper moisture to all material in said grooves;

a handle mounted on the front of said tray, said handle adapted for inserting, removing and carrying said tray; and, a space around said handle permitting air to circulate therethrough when said tray is in a humidor.

2. A tray as in claim 1 wherein said grooves have at least one rounded end.

3. A tray as in claim 2 wherein said grooves have two rounded ends .

4. A tray as in claim 1 wherein said tray is made of cedar wood.

5. A tray as in claim 1 adapted to slide into corresponding horizontal channels in the interior of a humidor, wherein said tray's fully inserted position in said humidor has gaps for air circulation around one or more edges of said tray.

6. A humidor comprising in combination:

a) a plurality of trays for supporting material in said humidor, each of said trays comprising a sliding board having in its upper surface a plurality of grooves adapted for receiving said material, said grooves arranged parallel to each other and each of the grooves having in its lowest part a lengthwise slot completely through said tray, said slot adapted to permit circulation of moist air therethrough in contact with said material while supporting said materials therein, said trays, grooves and slots having a configuration such as to direct moist air in said humidor to pass through said slots and recirculate in different directions, providing continuously proper moisture to all material in said grooves, and b) a humidistat for measuring the humidity of the air in said humidor, and c) a source of moisture and an air circulator for increasing the humidity of said air in said humidor when said air circulator is activated, and d) an activator responsive to said humidistat that activates said air circulator when the humidity measured by said humidistat is below a predetermined value and deactivates said air circulator when the humidity measured by said humidistat is not below said predetermined value, said activator increasing thereby the humidity of the air in said humidor when in its activated state, and e) handles mounted on the front of said trays, said handles adapted for inserting, removing and carrying said trays, and f) a space around said handle permitting air to circulate therethrough when said trays are in said humidor.

7. A humidor as in claim 6 wherein said activator is a fan.

8. A humidor as in claim 6 wherein said source of moisture is a water reservoir in contact with the air within said humidor.

9. A humidor as in claim 6 wherein said source of moisture and said air circulator have sufficient humidification capacity to maintain proper humidification in said humidor in the absence of sealed encasement.

10. A humidor as in claim 6 wherein said grooves in said trays have at least one rounded end.

11. A humidor as in claim 10 wherein said grooves in said trays have two rounded ends.

12. A humidor as in claim 6 wherein said trays are made of cedar wood.

13. A humidor as in claim 6 wherein said trays in said humidor are adapted to slide into corresponding horizontal channels in the interior of said humidor, wherein said trays fully inserted position in said humidor has gaps for air circulation around one or more edges of said trays.

* * * * *